US007191551B2

(12) United States Patent
O'Connor et al.

(10) Patent No.: US 7,191,551 B2
(45) Date of Patent: Mar. 20, 2007

(54) ARTICLES OF FOOTWEAR WITH COMPLEMENTARY AND/OR INTERLOCKING SOLE STRUCTURES

(75) Inventors: Kelly A. O'Connor, Beaverton, OR (US); William F. Rauchholz, Alexandria, VA (US)

(73) Assignee: Nike, Inc., Beaverton, OR (US)

( * ) Notice: Subject to any disclaimer, the term of this patent is extended or adjusted under 35 U.S.C. 154(b) by 165 days.

(21) Appl. No.: 11/058,417

(22) Filed: Feb. 16, 2005

(65) Prior Publication Data

US 2006/0179682 A1 Aug. 17, 2006

(51) Int. Cl.
*A43B 23/00* (2006.01)
*B65D 85/18* (2006.01)

(52) U.S. Cl. ..... 36/136; 36/11.5; 206/278; 206/806

(58) Field of Classification Search ..... 36/136, 36/132; 206/461, 806, 278
See application file for complete search history.

(56) References Cited

U.S. PATENT DOCUMENTS 1,909,942 A * 5/1933 Fingerman ..... 206/278
3,019,534 A * 2/1962 Kauffman et al. ..... 36/15
4,160,301 A * 7/1979 Woolley ..... 12/120.5
4,843,672 A * 7/1989 Fasse ..... 12/120.5
6,595,355 B1 * 7/2003 Hooper ..... 206/292
2005/0150137 A1 * 7/2005 Steidle ..... 36/136

FOREIGN PATENT DOCUMENTS

| | | |
|---|---|---|
| FO | 02U00025 | 9/2002 |
| JP | 11-342002 | 12/1999 |
| JP | 2001-008703 | 1/2001 |

* cited by examiner

*Primary Examiner*—Ted Kavanaugh
(74) *Attorney, Agent, or Firm*—Banner & Witcoff, Ltd

(57) ABSTRACT

Footwear systems include: (a) a holding device having an opening; (b) an article of footwear having a sole with a projection that extends through the opening; and (c) another article of footwear having a sole with a cavity into which the projection extends (thereby sandwiching the holding device between the soles). In other systems, the sole of one article of footwear includes two raised areas that fit through two openings provided in a holding device. The two raised areas fit into recessed areas provided adjacent a raised area of another footwear sole (thereby sandwiching the holding device between the soles). The projection(s) and/or raised area(s) on one sole may be sized and constructed so as to tightly fit (e.g., a friction fit) into corresponding cavity(ies) and/or recessed area(s) provided on the other sole, to thereby detachably hold the soles together and/or detachably engage with the holding device.

26 Claims, 6 Drawing Sheets

ARTICLES OF FOOTWEAR WITH COMPLEMENTARY AND/OR INTERLOCKING SOLE STRUCTURES

FIELD OF THE INVENTION

This invention relates generally to footwear. More specifically, the invention provides a system of footwear with complementary and/or interlocking sole structures, as well as methods and devices for displaying and/or storing footwear.

BACKGROUND

The various styles of conventional footwear include, for example, athletic footwear, sandals, dress shoes, and boots, and these articles of footwear typically are formed of two primary elements, namely an upper member and a sole structure. The specific structures and configurations of the upper member and/or the sole structure vary significantly depending, for example, upon the style of footwear, the intended use for the footwear, and the like. With regard to athletic footwear, for example, the upper member may cover the entire foot and may be formed from lightweight components. The sole structure may be formed of multiple layers, including a midsole and an outsole. The midsole typically attenuates ground reaction forces upon impact with the ground or other surface. The outsole, on the other hand, typically provides a durable, wear-resistant surface and may include texturing or other elements to enhance traction. In addition, the sole structure of athletic footwear may include an insole that is positioned within or adjacent the upper member and adjacent to the sole of the foot in order to enhance the comfort of the footwear. The insole often is secured within the upper member with an adhesive to prevent it from moving relative to other portions of the footwear.

Historically, shoe stores or retail areas were configured to provide limited showroom space where customers viewed samples of shoes. Typically, a representative model of each shoe would be displayed, often in only a single size and/or as a single shoe. The remaining footwear inventory typically is stored in an inventory or storeroom area that is partitioned from the showroom and accessible only by store personnel. This configuration allowed a greater selection of shoe styles to be presented to customers in a smaller space. Because customers had varying shoe sizes, when a customer expressed interest in a particular shoe style, store personnel would need to check for the desired size in the inventory area, obtain the specific size and model requested by the interested customer (if available), and deliver the shoe to the customer for fitting.

Eventually, as the shoe business became more price competitive, some store owners concluded that significant employee time and effort was being expended on the unprofitable and time-consuming task of shoe retrieval from the inventory area and shoe fitting. As a result, store redesign efforts focused on ways to allow salespersons to spend more time on the sales floor directly assisting customers and less time retrieving shoes for potential customers. For example, shoe store designs began to eliminate the inventory area in favor of designs in which all or substantially all of the shoes, in all the available sizes (i.e., the complete inventory), were available on the showroom floor. These designs, however, have certain disadvantages. First, because all of the shoes are present on the showroom floor, it is difficult to organize the shoes in an efficient manner. Second, because customers are expected to find their own size and model of shoe, the shoes needed to be displayed so that customers can easily identify and access the desired model and size of a shoe. Current shoe store designs of this "warehouse" type, with large and high stacks of shoe boxes in large long rows, can make location of desired shoes by customers a difficult, time-consuming, and frustrating task.

Many conventional footwear designs also do not allow for effective storage and retrieval of footwear in the consumer's home once the footwear is purchased. For example, people often fill closets or other storage spaces with many pairs of shoes, often of various different sizes and/or belonging to multiple wearers. As the articles of footwear get moved around, individual shoes of a pair often become separated, resulting in difficulty finding a matching pair. Moreover, travelers sometimes forget to pack both shoes in a pair because the shoes are inadvertently separated.

The above issues cause inconvenience, frustration, and inefficiencies for footwear wholesalers, retailers, and users.

SUMMARY

Aspects of this invention relate to footwear systems that allow footwear to be easily held, displayed, and/or hung (e.g., for storage) in an efficient manner that maintain shoes of a pair together. Optionally, such systems may be used both in a sales environment and in an ultimate end user's home environment.

More specific aspects of this invention relate to footwear systems that include one or more holding devices that, in at least some instances, may be used for storing, hanging, and/or displaying the footwear, may be used as a communication or messaging medium, or the like. Footwear systems in accordance with at least some example aspects of this invention may include: (a) a holding device including a body member with a first opening defined therein; (b) a first article of footwear having a first sole member, wherein the first sole member includes a first projection, and wherein the first projection extends through the first opening of the holding device; and (c) a second article of footwear having a second sole member, wherein the second sole member includes a first cavity defined therein, wherein the first projection extends into the first cavity such that the holding device is sandwiched between the first sole member and the second sole member. At least a portion of the holding device may extend outside of the first sole member and the second sole member, and this extending portion may be used to suspend the holding device (optionally with footwear attached thereto) to another element. Plural projections may be provided on the various sole members that extend through plural corresponding openings provided in the holding device body member and into plural corresponding cavities provided in the other sole member without departing from this invention.

Other footwear systems in accordance with example aspects of this invention may include: (a) a first article of footwear having a first sole member, wherein the first sole member includes a first raised area and a second raised area with a first recessed area provided between the first raised area and the second raised area; (b) a second article of footwear having a second sole member, wherein the second sole member includes a third raised area, wherein the third raised area at least partially fits inside the first recessed area of the first sole member; and (c) a holding device including a body member with a first opening and a second opening defined therein, wherein the first raised area extends into the first opening, the second raised area extends into the second opening, and a portion of the body member between the first opening and the second opening lies adjacent the third raised area (e.g., also adjacent the first recessed area and held between the third raised area and the first recessed area). Any number of raised areas and corresponding recessed areas may be provided in the various sole members, and/or any number of openings may be defined in the holding device body member without departing from this aspect invention.

Additional aspects of the invention relate to holding devices for footwear articles. Such holding devices may include: a body member, wherein a means or structure for suspending the holding device is included as part of and/or engaged with the body member to provide an area for suspending the device (e.g., to suspend the holding device from a door, from a hook, from a rod, etc.), and wherein at least a first opening and a second opening are defined in the body member for receiving protrusions extending from a sole member of at least one article of footwear. Holding devices in accordance with at least some examples of this invention further may include a message display area, e.g., making up at least a portion of the body member. The message display area may take on any suitable form, such as an erasable display area (such as a whiteboard material), a pad or roll of paper, or the like, for receiving a user's handwritten message and displaying it for viewing by others.

Still additional aspects of this invention relate to methods for holding articles of footwear, e.g., for sales, display, storage, or other purposes. Such methods may include: (a) securing a holding device to at least a first projection extending from a sole member of a first article of footwear (e.g., from a bottom of an outsole member) by extending the first projection through a first opening defined in the holding device; and (b) engaging the first projection with a first cavity or recess area provided in a sole member of a second article of footwear to thereby detachably connect the first article of footwear to the second article of footwear. In such methods, the holding device may be sandwiched between the sole member of the first article of footwear and the sole member of the second article of footwear, and all three elements may be held together, e.g., by a tight friction fit between the projection and the opening in the holding device and/or the cavity of the recessed area of the second sole member. The holding device further may be suspended on another element, such as a sales display device, a door opening device, a closet rod, a hook, etc., optionally with one or more articles of footwear attached thereto. Various means or structures may be provided for suspending the holding device, such as an opening provided in the holding device, e.g., in an area of the holding device located outside the sole members of the first and second articles of footwear. Of course, if desired, additional projections on sole members may extend through additional corresponding openings provided in the holding device and engage in additional corresponding cavities or recesses provided in the other sole member without departing from this invention.

Additional method aspects according to the invention further may include: detaching the sole member of the first article of footwear from the sole member of the second article of footwear, detaching the holding device from the sole member of the first article of footwear; and/or hanging the holding device on a door, hook, rod, or other element (optionally after detaching the holding device from the various sole members). Aspects of the invention further may include writing a message in a message display area of the holding device before, during, and/or after it is hung on a door or another element.

BRIEF DESCRIPTION OF THE DRAWINGS

A more complete understanding of the present invention and at least some advantages thereof may be acquired by referring to the following description and the accompanying drawings, in which like reference numbers indicate like features, and wherein.

DETAILED DESCRIPTION

Figure 3:
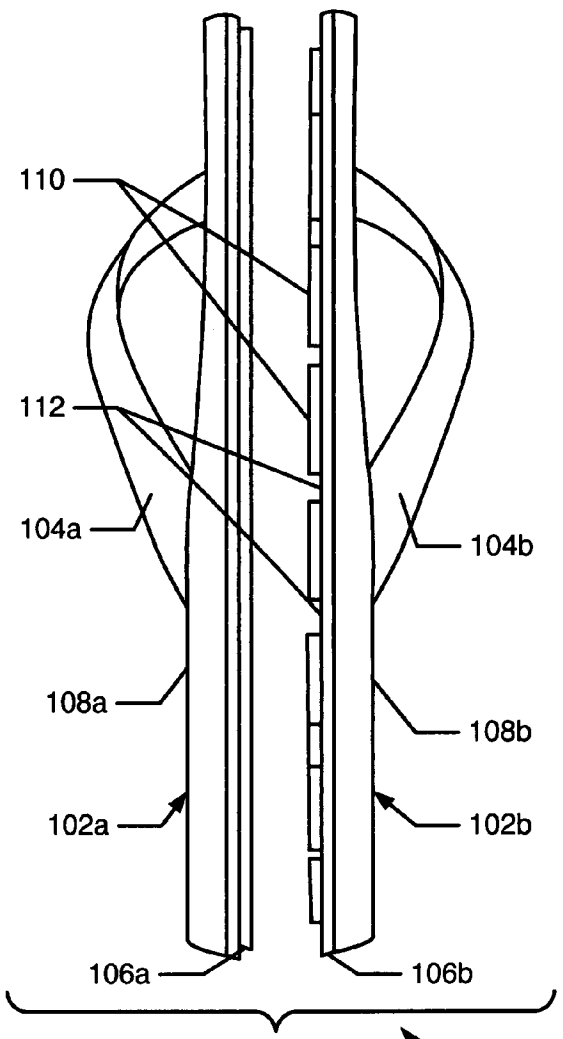
FIGS. 1, 2, and 3 illustrate top plan, bottom plan, and side views of example articles of footwear that may be used in accordance with examples of the present invention.
Figure 1:
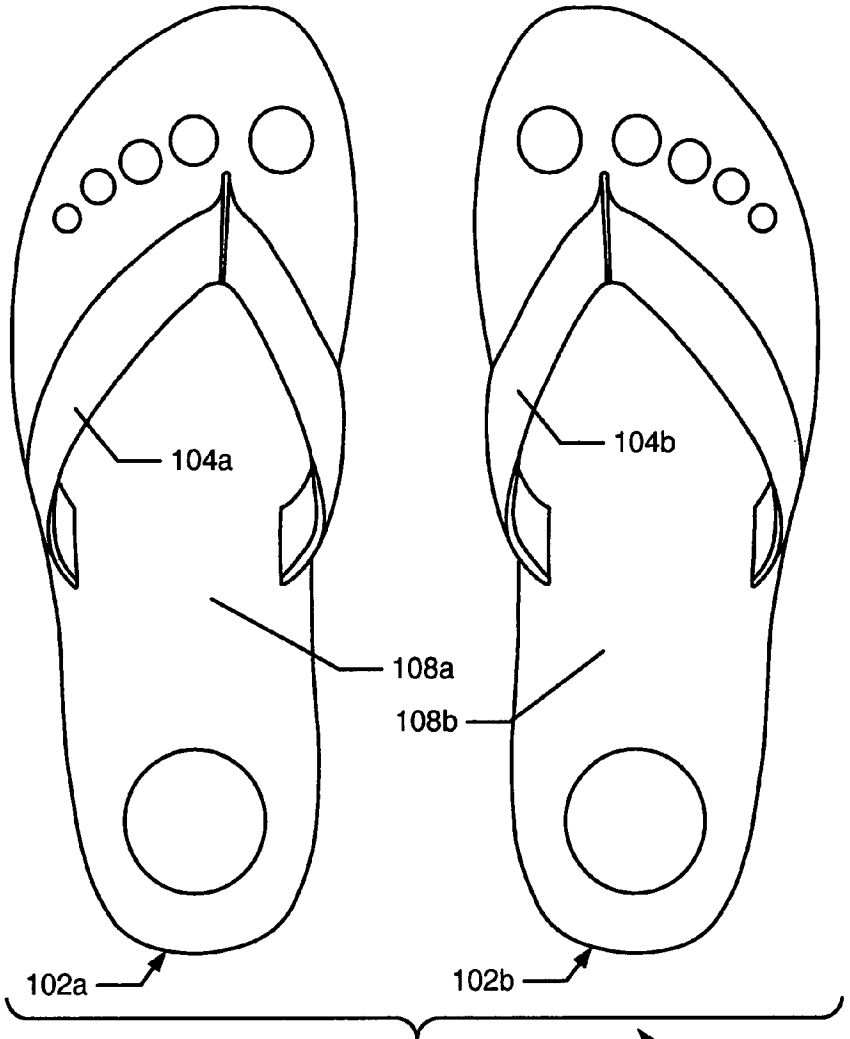

In the following description of various examples of the present invention, reference is made to the accompanying drawings, which form a part hereof, and in which are shown by way of illustration various structures, embodiments, and examples in which aspects of the invention may be practiced. It is to be understood that other embodiments may be utilized and structural and functional modifications may be made without departing from the scope of the present invention.

FIGS. 1–8 illustrate various features of a first example of a footwear system 100 in accordance with this invention. As an initial matter, the footwear system 100 includes a footwear pair 102, one article of footwear 102*a* for the left foot and one article of footwear 102*b* for the right foot. FIGS. 1–4 illustrate various example features of the footwear pair 102. While the illustrated example footwear pair 102 of FIGS. 1–4 is in the form of a pair of sandals, those skilled in the art will recognized that aspects of this invention may be practiced with any type or style of footwear, including, but not limited to: all types of shoes, boots, sneakers, sandals, thongs, flip-flops, mules, scuffs, slippers, sport-specific shoes (such as golf shoes, tennis shoes, baseball cleats, soccer or football cleats, ski boots, etc.), and the like.

Each article of footwear of the footwear pair 102 includes an upper member (104*a* and 104*b*, in the illustrated example) and a sole structure (106*a* and 106*b*, in the illustrated example). While in the example structures illustrated in FIGS. 1–8 the upper members 104*a* and 104*b* constitute sandal straps, those skilled in the art will appreciate that any type of upper member may be provided without departing from the invention, including upper members suitable for all types of articles of footwear, like those identified above. Examples of suitable materials for upper members 104*a* and 104*b* that may be used in accordance with examples of this invention include, but are not limited to, one or more of: rubber materials, elastic materials, canvas or other cloth materials, other plastic or polymeric materials, leather, synthetic leather materials, and/or other materials, including materials conventionally known and used in the art for upper members.

The articles of footwear 102*a* and 102*b* each also may include a footbed 108*a* and 108*b*, respectively, that supports the sole of the wearer's foot while wearing the articles of footwear 102*a* and 102*b*. The footbeds 108*a* and 108*b* may be part of the sole structure 106*a* and 106*b*, such as part of an insole or midsole of a conventional article of footwear, they may constitute part of the upper member structure, and/or they may constitute (at least in part) a separate entity from both the upper member and the sole structure. The footbeds 108*a* and 108*b* may be constructed from various different types of materials without departing from the invention, including materials suitable as a direct or indirect point of contact for a foot, such as various types of rubbers, synthetic materials, foam materials, cloth materials, and the like, including materials conventionally known and used in the art for footwear insoles and/or for footbeds.

The sole members 106*a* and 106*b* of articles of footwear 102*a* and 102*b*, respectively, in accordance with examples of this invention also may take on various forms, structures, and constructions without departing from this invention. For example, the sole members 106*a* and 106*b* may include conventional insole, midsole, and/or outsole forms, structures, and/or constructions, like those used in conventional athletic footwear and/or other known or conventional articles of footwear. Additionally, the sole members 106*a* and 106*b* may be formed from any desired materials, including conventional materials known and used in the art, without departing from this invention. When present in footwear, midsoles provide stability and attenuate impact or ground reaction forces when a wearer's foot contacts the ground or other surface. Midsoles may be made from various different materials, including layers of various different materials. Materials for inclusion in a midsole for use in accordance with at least some examples of this invention include ethylvinylacetate ("EVA"), polyurethane ("PU"), synthetic foam materials, and/or other materials, including materials, conventionally known or used in the art for footwear midsole construction. The midsole and/or other portions of the sole structure 106*a* and 106*b* also may include ground or impact force attenuating elements, such as inserts with pressurized gases (such as air or other gases) enclosed in airtight envelopes (such as urethane bags or the like) (also known as "gas-filled bladders" or "heel pucks"), or an additional EVA pad placed beneath the wearer's heel to protect the heel from excessive impact and/or instability. Other additional forms of impact-attenuating elements for use in a midsole or other portion of a sole structure 106*a* and 106*b* may include plastic elastomers, combinations of plastic elastomers, thermoplastic polymer resin, rubbers or some other materials, including conventional materials known and used in the art. Many other structures, including various structures of impact-attenuating elements, may be included in sole structures 106*a* and 106*b* useful in accordance with this invention.

As noted above, sole members 106*a* and 106*b* in accordance with examples of this invention further may include an outsole member. Outsole members typically are the part of an article of footwear 102*a* and 102*b* designed to provide a secure and stable contact point with the ground when the footwear 102*a* and 102*b* is worn and in use (the term "ground," as used herein, means any surface on which the article of footwear 102*a* and 102*b* contacts in use, including, for example, snow, ice, dirt, grass, tile, flooring, carpet, synthetic grass, etc.). Outsoles may be designed and constructed from materials to achieve an effective balance of traction and durability. As examples, at least the bottommost portions of sole members 106*a* and 106*b* of the example structures shown in FIGS. 1–4 may be constructed from various materials (or combinations of materials), including carbon rubber, blown rubber, high pressure rubber "HPR")), solid rubber, duralon, or other outsole materials, including materials conventionally known and used in the art as outsole materials.

Figure 4:
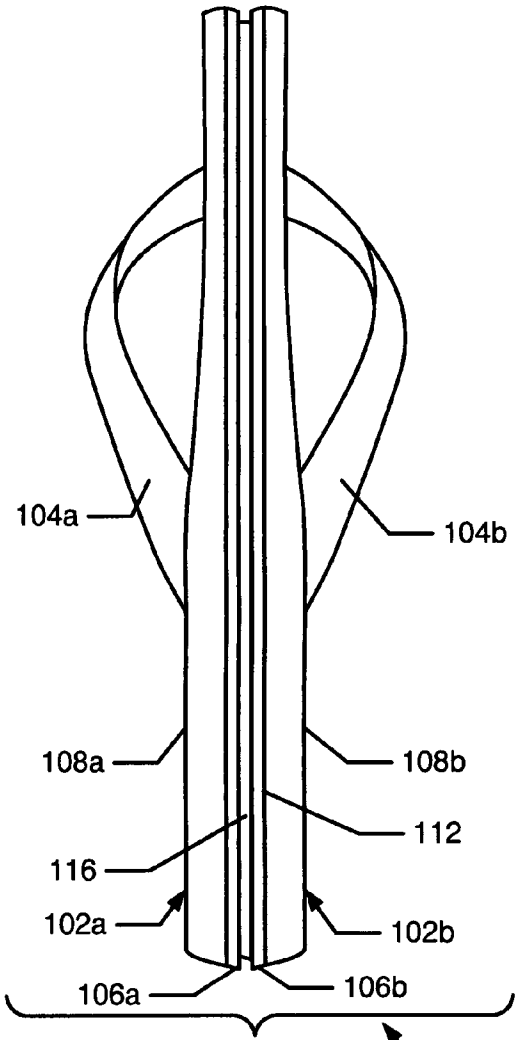
FIG. 4 illustrates a side view of the example articles of footwear of FIGS. 1–3 detachably connected to one another.
Figure 2:
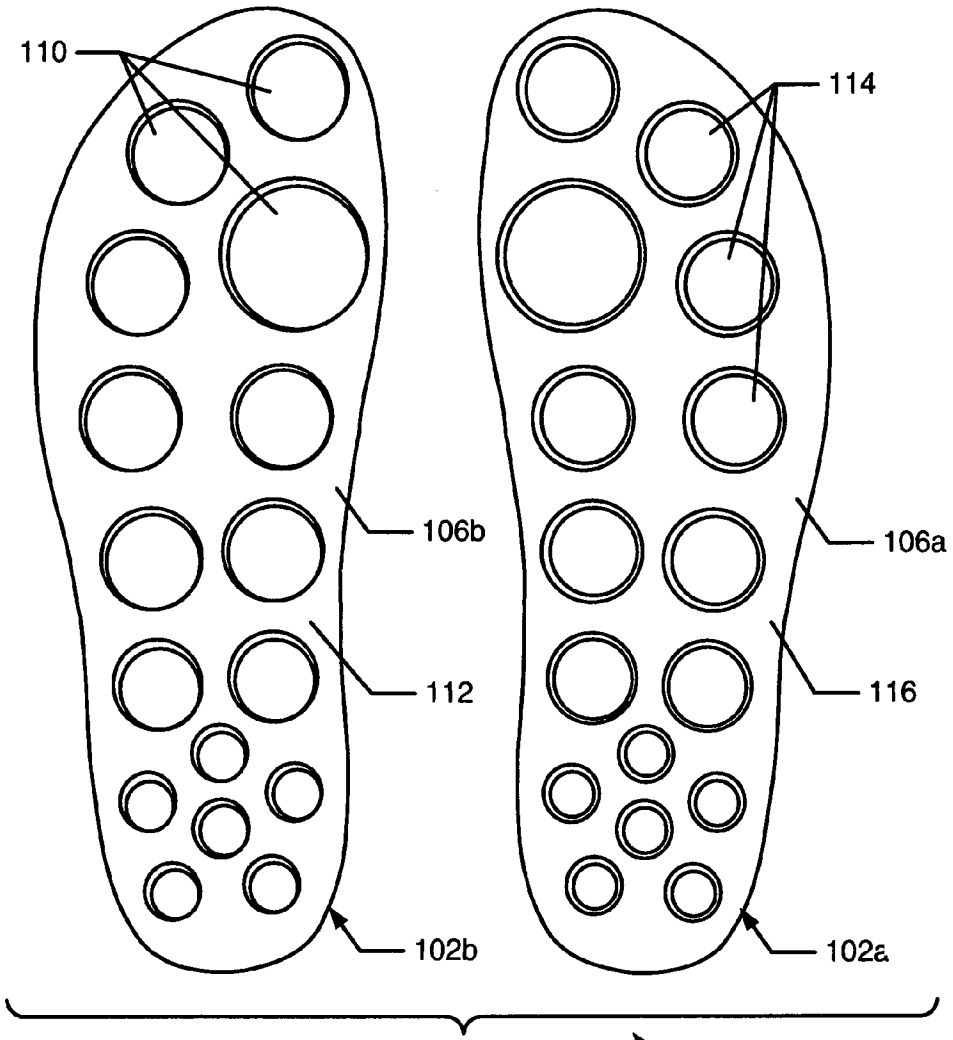

Sole members 106*a* and 106*b* may take on various forms in accordance with examples of this invention. For example, as illustrated in FIG. 2, the bottom surface of sole member 106*b* of article of footwear 102*b* includes a plurality of projections 110 raised up from a base surface 112 of the outermost surface of the sole member 106*b*. Additionally, as further illustrated in FIG. 2, the bottom surface of sole member 106*a* of article of footwear 102*a* includes a plurality of cavities 114 formed in the base surface 116 of the outermost surface of the sole member 106*a*. The various projections 110 and cavities 114 may be sized, arranged, and located on their respective base surfaces 114 and 116 so that the projections 110 will fit into and/or engage the cavities 114, optionally in a tight friction fit, to thereby detachably engage and/or hold the two articles of footwear 102*a* and 102*b* together, as illustrated by FIGS. 3 and 4.

Any size, shape, orientation, and/or arrangement of projections 110 and/or cavities 114 may be provided without departing from the invention. For example, as shown in FIG. 2, in the illustrated example, the projections 110 and cavities 114 are circular shaped, and various different sized projections 110 and cavities 114 are provided on each article of footwear. Various other shapes of projections and corresponding cavities for receiving the projections also may be provided without departing from the invention, including, for example, triangular, square, rectangular, or other polygon shaped; star shaped; oval shaped; elongated raised rib and groove shaped; irregularly shaped; etc. A variety of differently shaped projections and/or cavities may be provided on a single article of footwear, if desired. Also, a single article of footwear need not include only projections or only cavities. Rather, if desired, the bottom surface of a single article of footwear may include both projections and cavities that are received into and/or fit together with corresponding cavities and projections provided in its corresponding mating article of footwear. Of course, many other variations in the size, shape, orientation, and arrangement of projections and/or cavities may be provided in articles of footwear without departing from the invention. Additional examples of differently shaped projections and cavities will be described in more detail below in conjunction with the example structure illustrated in FIGS. 9–12.

Figure 5:
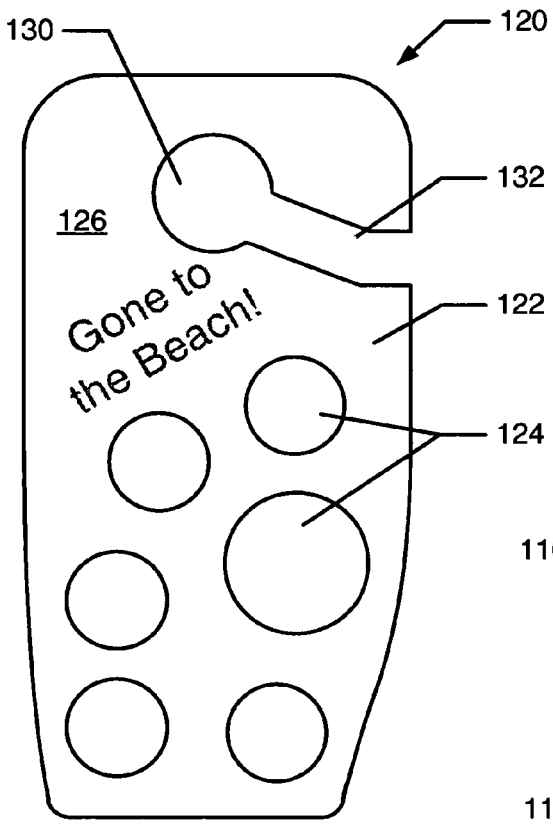
FIG. 5 illustrates a plan view of an example holding device useful in some examples of this invention.
Figure 6:
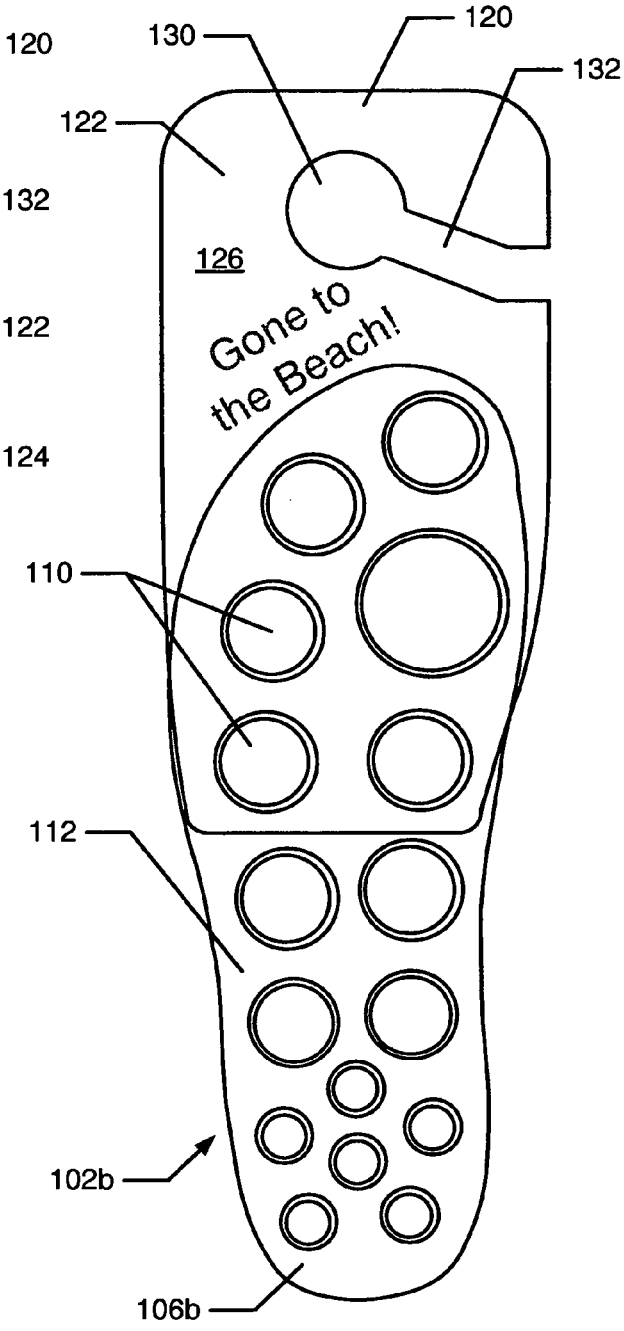
FIG. 6 illustrates a plan view of the holding device of FIG. 5 attached to the sole member of the article of footwear illustrated in FIGS. 1–4.

FIGS. 5–8 illustrate additional features in accordance with at least some examples of this invention. Specifically, FIG. 5 illustrates a holding device 120 that may be used in accordance with at least some example aspects of this invention. The holding device 120, as illustrated in FIG. 5, includes a body member 122, which may be made from a metal, plastic, cardboard, paper, or other suitable or desired materials, e.g., at least partially in a planar or substantially planar construction (e.g., as a thin, substantially planar construction at least in the area that lies adjacent the shoe soles, as will be described in more detail below). The body member 122 of holding device 120 includes one or more openings 124 defined therein. As shown in FIG. 6, these openings 124 may be sized, shaped, arranged, and located such that one or more of the projections 110 of sole member 106*b* fit into and extend through the openings 124. In the example structure shown in FIG. 5, the holding device 120 includes several openings 124, of various different sizes, to generally match the sizes and shapes of projections 110 provided in the forefoot or toe portion of the corresponding article of footwear 102*b*. Of course, if desired, without departing from this invention, the holding device 120 could be provided with openings so as to match the size, shape, and/or arrangement of projections 110 provided in a rearfoot or heel portion of a corresponding article of footwear, to match the size, shape, and/or arrangement of projections 110 provided at a lateral or medial side portion of a corresponding article of footwear, and/or to match the size, shape, and/or arrangement of all or substantially all of the projections provided in a sole structure of an article of footwear (e.g., if desired, the holding device body member 122 could cover or engage other portions of the sole member 106*b*, or it could even cover or engage all or substantially all of the sole member 106*b*).

Figure 7:
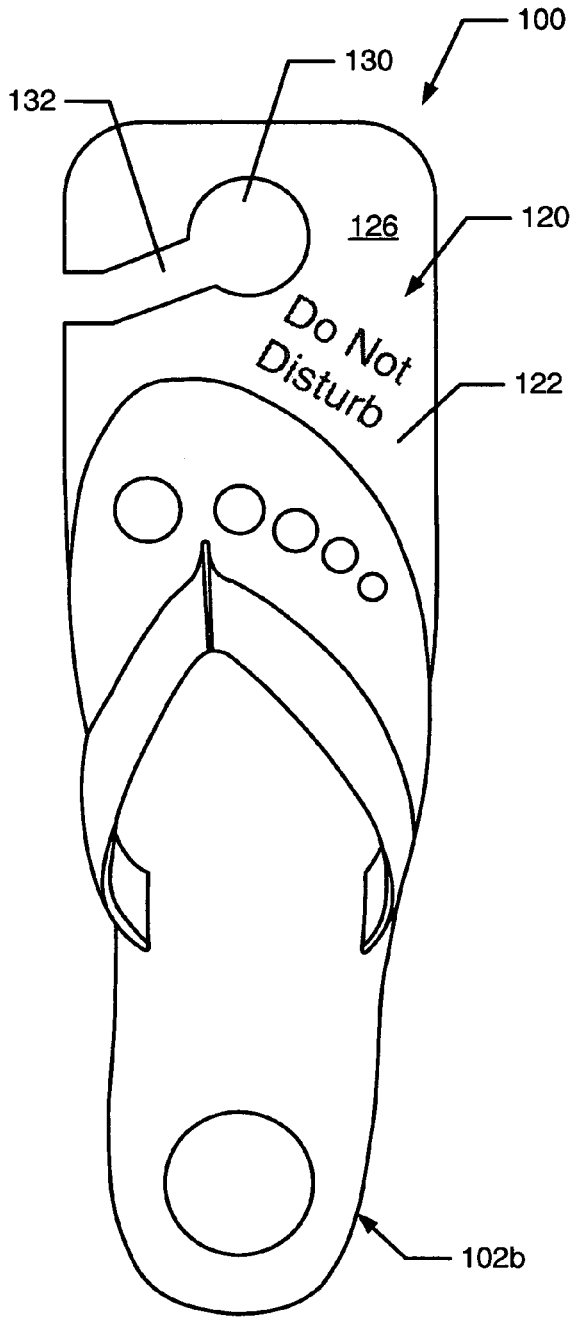
FIGS. 7 and 8 illustrate plan and side views, respectively, of the holding device of FIG. 5 attached to the example articles of footwear illustrated in FIGS. 1–4 to thereby provide an example footwear system in accordance with this invention.
Figure 8:
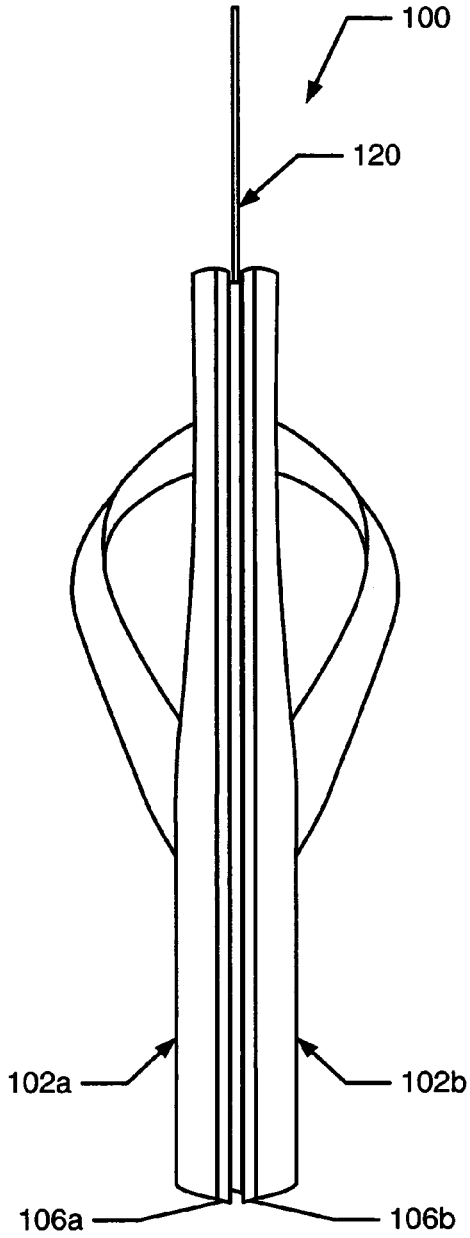

When at least the portion of the holding device 120 that includes the openings 124 for engaging the projections 110 (e.g., the portion that lies adjacent to the shoe soles) is thinner than the height of the projections 110, the projections 110 with extend through the openings 124 and remain available to engage the corresponding cavities 114 provided on the other article of footwear 102*a*. In this manner, at least a portion of the holding device 120 may be sandwiched between the sole member 106*a* of one article of footwear 102*a* and the sole member 106*b* of the other article of footwear 102*b* when the projections 110 and cavities 114 of the two articles of footwear 102*a* and 102*b* are detachably engaged with one another in the manner described above in conjunction with FIGS. 3 and 4. FIGS. 7 and 8 illustrate plan and side views, respectively, of an entire footwear system 100 in accordance with at least some examples of this invention with two articles of footwear 102*a* and 102*b* detachably engaged with one another, with a holding device 120 sandwiched and engaged between them.

If desired, in at least some examples of the invention, the projections 110, openings 124, and cavities 114 may be sized, shaped, and arranged so that the projections 110 tightly fit into the openings 124 and/or the cavities 114, such that the two articles of footwear 102*a* and 102*b* may be held together in a detachable manner by a tight friction fit without other elements or components holding them together. In other examples, if desired, the projections 110 may extend freely through the openings 124 and still engage the cavities 114 in a tight friction fit, to thereby hold the system 100 together. In still other examples, if desired, all three elements 110, 114, and 124 may be loosely engaged together without a tight friction fit, and the overall system 100 may be held together by an additional member or component, such as an elastic or rubber band or string, an adhesive, a sleeve, a portion of the upper member and/or sole structure, etc.

Optionally, in accordance with at least some examples of this invention, the holding device 120 may include at least some portion 126 (e.g., a portion of body member 122) that extends outside the sole members 106*a* and/or 106*b* when the holding device 120 is engaged with the articles of footwear 102*a* and/or 102*b*. This portion 126 (and/or any portion of the holding device 120) may include printed information, such as information relating to the footwear (e.g., for use in a sales environment, such as its size, brand name, manufacturer name, or other information); preprinted message information (e.g., "Gone to the Beach!," "Do Not Disturb," etc.); and/or any other desired information.

The portion 126 of the holding device 120 that extends outside of the sole members 106*a* and 106*b* may be constructed in such a manner and/or include various features that allow the holding device 120 itself and/or the entire system 100 to be suspended, e.g., for display or storage purposes (e.g., at a retail location, at home, etc.). Any type of suspension device or system may be used without departing from this invention. For example, as illustrated in FIGS. 5–7, the suspension system may include an opening or aperture 130 defined in the body member 122 of the holding device 120. If desired, a slit, canal, or other opening 132 may lead from the edge of the body member 122 to the opening 130 to allow the holding device 120, optionally with an attached pair of footwear 102, to be suspended from and/or attached to another element, such as a hook, a sales display, a door knob or other opening device, a closet rod, etc. As other potential alternatives, the suspension device or system for the holding device 120 may include a string or flexible plastic element that is attached to the body member 122 (e.g., extends from one side of the holding device 120 to the other, extends from a central area of the body member 122, etc.) to allow the holding device 120, optionally with an attached pair of footwear 102, to be suspended from and/or attached to another element, as described above. As still another example, the suspension system for the holding device may include an elongated flat region that is received in the slot of a card reading device, e.g., like card reading devices used as securing systems for many hotel rooms. As still additional options, the suspension system or device may be at least partially detachable from the remainder of the holding device 120, if desired. Any other desired types of suspension systems or devices may be used without departing from this invention.

If desired, the portion 126 of the holding device 120 that extends outside of the sole members 106*a* and 106*b* may have a thickness, dimensions, size, shape, and/or other characteristics different from the portion of the holding device 120 including the openings 124 and/or that lies adjacent to and/or engages the sole members 106*a* and 106*b* of the articles of footwear 102*a* and 102*b*. Many variations in the structure of the portions 126 of the holding device 120 that extend outside of the sole members 106*a* and 106*b* are possible without departing from this invention, and some of these potential variations are described in more detail below.

Figure 10:
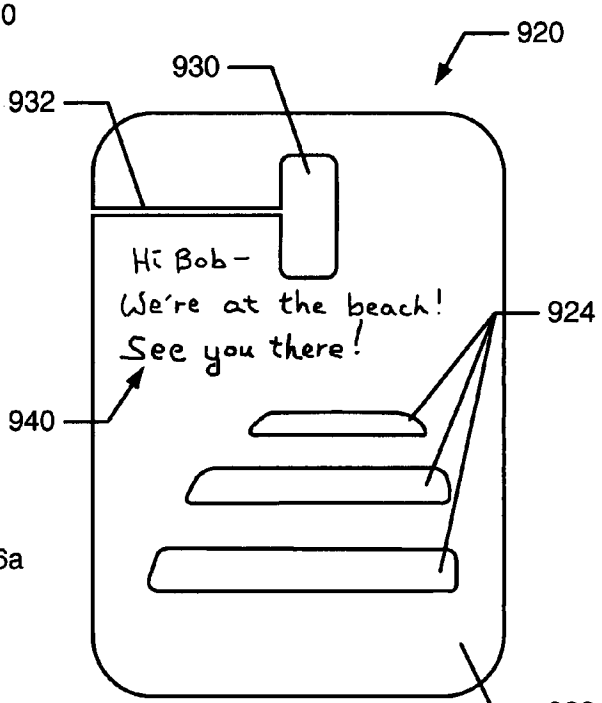
FIG. 10 illustrates a plan view of an example holding device useful with the example articles of footwear shown in FIG. 9.
Figure 9:
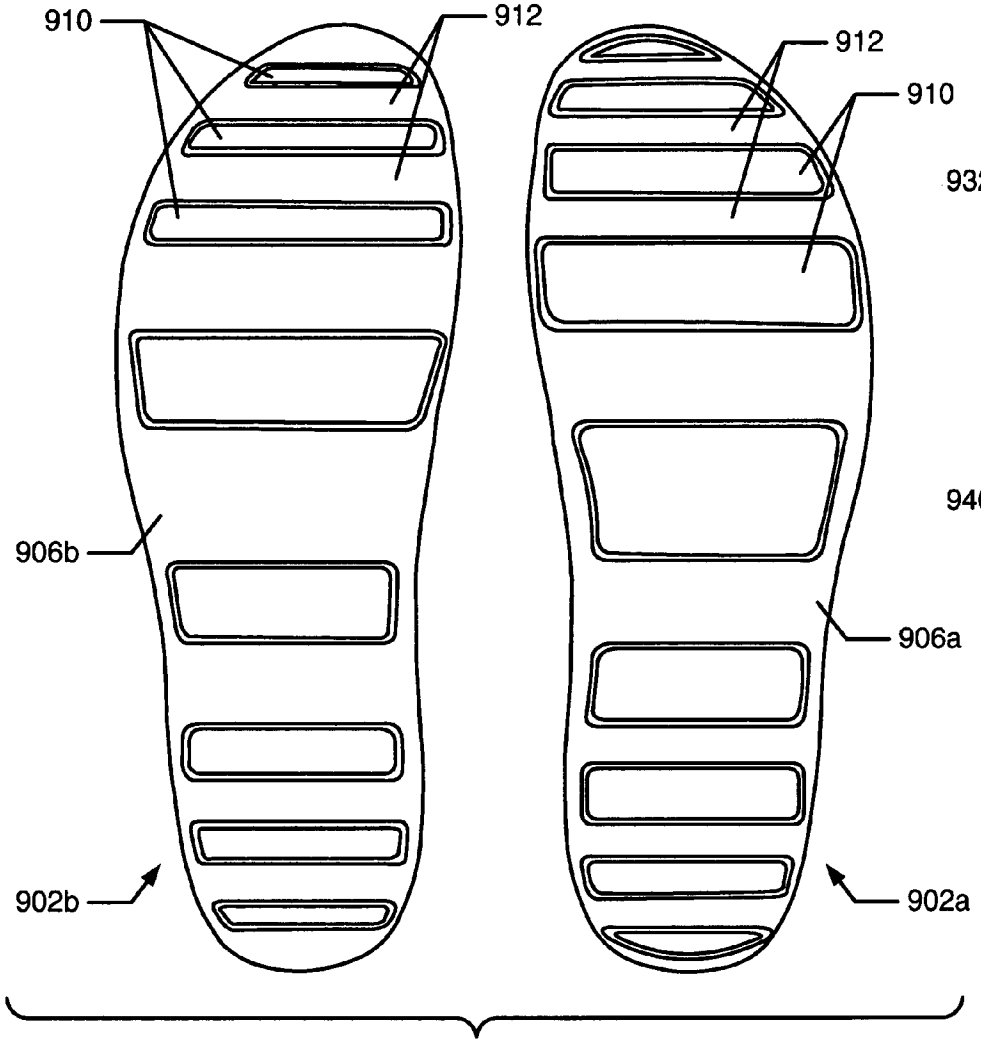
FIG. 9 illustrate a bottom plan view of example articles of footwear that may be used in accordance with other examples of the present invention.
Figure 11:
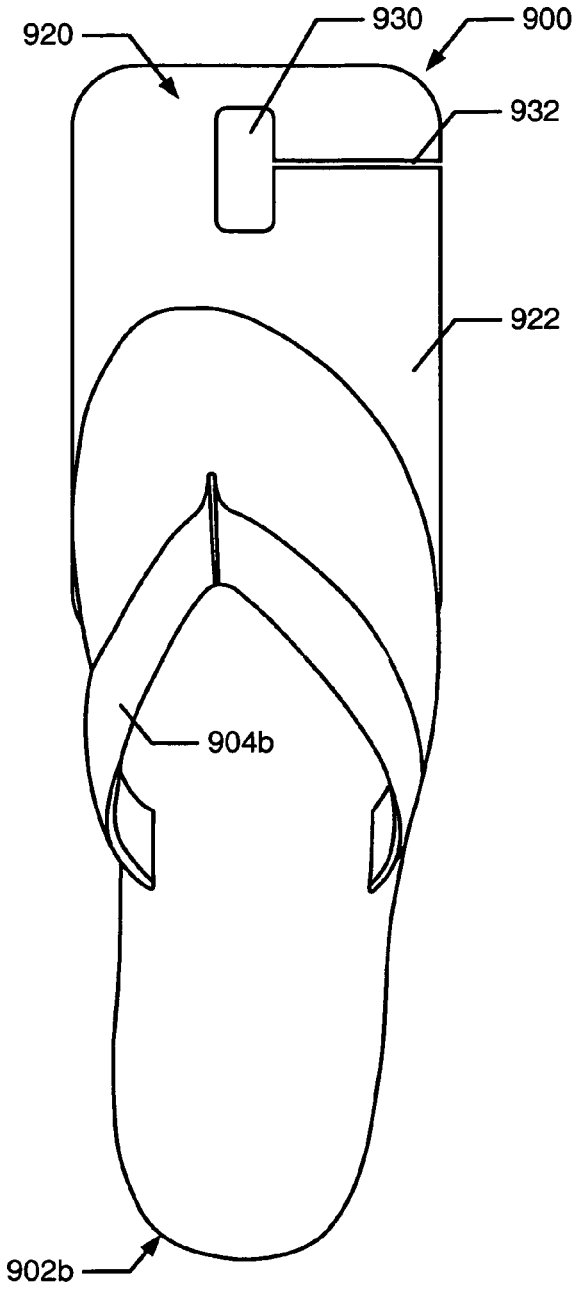
FIGS. 11 and 12 illustrate plan and side views, respectively, of the holding device of FIG. 10 attached to the example articles of footwear illustrated in FIG. 9 to thereby provide an example footwear system in accordance with this invention.
Figure 12:
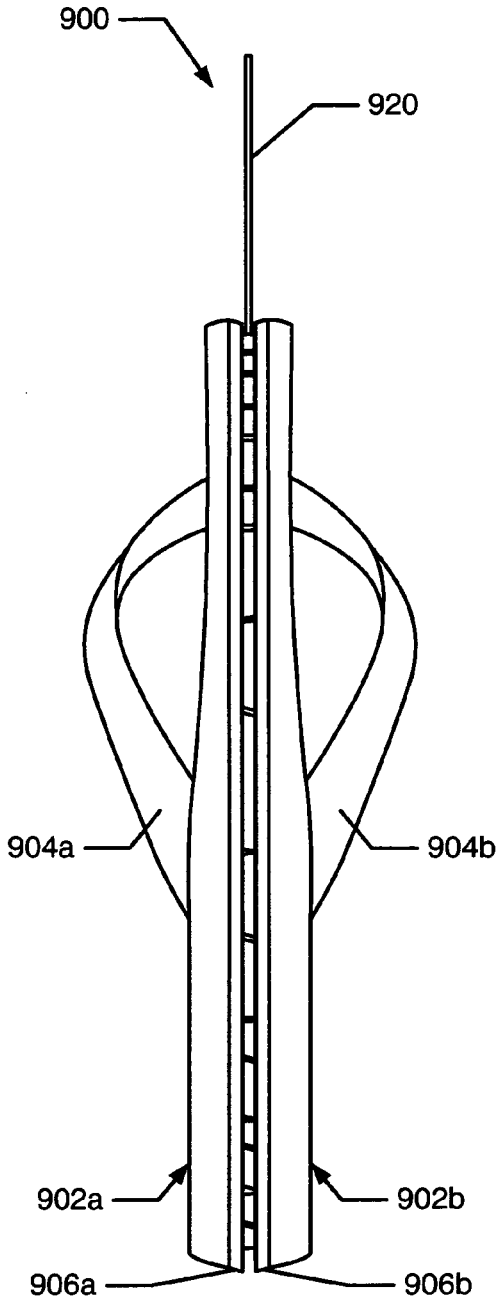

FIGS. 9–12 illustrate features of another example of a footwear system 900 in accordance with example aspects of this invention. FIG. 9 illustrates the sole members 906*a* and 906*b* of articles of footwear 902*a* and 902*b*, respectively (the upper members and/or the remainder of the sole structures of the articles of footwear 902*a* and 902*b* may take on any desired form, including, if desired, the forms of upper members 904*a* and 904*b* and the remainder of the sole structures illustrated in FIGS. 11 and 12). In this example structure, as illustrated in FIG. 9, the sole members 906*a* and 906*b* of each article of footwear 902*a* and 902*b*, respectively, include at least first and second raised areas 910 with recessed areas 912 provided between and/or extending around the raised areas 910. The various raised areas 910 and recessed areas 912 may be arranged such that the raised areas 910 on one sole member fit into recessed areas 912 on the other sole member (e.g., raised areas 910 on sole member 906*a* fit into recessed areas 912 on sole member 906*b* and raised areas 910 on sole member 906*b* fit into recessed areas 912 on sole member 906*a*). In this manner, the two sole members 906*a* and 906*b* may be fit together in a compact fashion, e.g., as illustrated in FIG. 12. In at least some examples of the invention, the raised areas 910 of at least one shoe and the corresponding recessed areas 912 into which they fit on the other shoe will be sized and shaped such that a relatively tight, friction fit or interlocking arrangement is made, e.g., so that the two articles of footwear 902*a* and 902*b* will releasably hold together. Of course, any number, size, shape, and/or arrangement of raised areas 910 and recessed areas 912 may be provided on articles of footwear without departing from this invention.

FIGS. 10–12 further illustrate an example holding device 920 that may be used in footwear systems, including footwear systems 100 and 900 of the type described herein. In this example structure, the holding device 920 includes a body member 922 having one or more openings 924 defined therein for receiving one or more corresponding raised areas 910 on one or both of the articles of footwear 902*a* and/or 902*b*. In at least some examples, two (or more) of the raised areas 910 on one article of footwear 902*a* or 902*b* may fit into adjacent openings 924 provided in the holding device. In this manner, a portion of the body member 922 of the holding device 920 will be sandwiched between the recessed area 912 on one article of footwear (e.g., 902*a*) and the corresponding raised area 910 on the other article of footwear (e.g., 902*b*). In the illustrated example, the openings 924 in holding device 920 are somewhat elongated and extend in a direction from one side of the body member 922 toward the other side, e.g., to engage the elongated raised areas 910 provided on footwear article 902*a*.

In at least some examples of the invention, if desired, the holding device 920 may include openings 924 sized, shaped, and arranged to engage raised areas 910 on each of the articles of footwear 902*a* and 902*b*. Many other variations in the size, shape, and arrangement of the raised areas 910, recessed areas 912, and/or openings 924 are possible without departing from the invention. For example, if desired, at least some of the raised areas 910 may make a relatively tight friction fit in the corresponding openings 924 and/or the recessed areas 912, as described above, such that no other attachment elements are needed to hold the system 900 together. Alternatively, if desired, an additional attachment system may be used to hold system 900 together, in at least some examples of the invention, such as string, elastic bands, paper or other sleeves, elements included as part of the upper member and/or sole structure, etc.

Optionally, in accordance with at least some examples of this invention, the holding device 920 may include at least some portion (e.g., a portion of body member 922) that extends outside the sole members 906*a* and/or 906*b* when the holding device 920 is engaged with its corresponding articles of footwear 902*a* and/or 902*b* (e.g., in the manner illustrated in FIGS. 11 and 12). The portion of the holding device 920 that extends outside of the sole members 906*a* and 906*b* may be constructed in such a manner and/or include various features that allow the holding device 920 itself and/or the entire system 900 to be suspended, e.g., for display or storage purposes (e.g., at a retail location, at home, etc.). Any type of suspension device or system may be used without departing from this invention. For example, as illustrated in FIGS. 10–12, the suspension system may include an opening or aperture 930 defined in the body member 922 of the holding device 920. If desired, a slit, canal, or other opening 932 may lead from the edge of the body member 922 to the opening 930 to allow the holding device 920 (optionally with attached articles of footwear 902*a* and/or 902*b*) to be suspended from and/or attached to another element, such as a hook, a sales display, a door knob or other opening device, a closet rod, etc. As other potential alternatives, the suspension device or system for the holding device 920 may include a string or flexible plastic element that is attached to the body member 922 (e.g., extends from one side of the holding device 920 to the other, extends from a central area of the body member 922, etc.) to allow the holding device 920 (optionally with attached articles of footwear 902*a* and 902*b*) to be suspended from and/or attached to another element, as described above. As still another example, the suspension system for the holding device may include an elongated flat region that is received in the slot of a card reading device, e.g., like card reading devices used as securing systems in many hotel rooms. As still additional options, the suspension system or device may be at least partially detachable from the remainder of the holding device 920, if desired. Any other desired types of suspension systems or devices may be used without departing from this invention.

If desired, the portion of the holding device 920 that extends outside of the sole members 906*a* and 906*b* may have a thickness, dimensions, size, shape, and/or other characteristics different from the portion of the holding device 920 including the openings 924 and/or that lies adjacent to and/or engages the sole members 906*a* and 906*b* of the articles of footwear 902*a* and 902*b*. Many additional variations in the structure of the portions of the holding device 920 that extend outside of the sole members 906*a* and 906*b* are possible without departing from this invention.

Any types of materials may be used for the holding devices, e.g., devices 120 and/or 920, without departing from this invention, including, for example, paper products, cardboard products, plastics (such as thermosetting or thermoplastic polymeric materials), metals, and the like. In at least some examples of the invention, at least some portion of the holding device body member (e.g., body member 922 in FIG. 10) may include a message display area. The message display area, in at least some examples of this invention, may include pre-printed messages or information (e.g., size, company name, brand name, message information, etc.), some sort of erasable or otherwise reusable display on which a user may create and leave a handwritten message, or the like. For example, as illustrated in FIG. 10, the body member 922 of holding device 920 may be constructed from or coated with a material that allows users to apply a handwritten message 940 using a felt tipped pen, marker, or other ink dispensing mechanism (e.g., a material such as that used for producing conventional whiteboards or other erasable displays or materials). In this manner, users could remove the articles of footwear 902*a* and 902*b* from the holding device 920, write a message 940 for another person directly on the holding device 920, and leave the holding device 920, including the message 940 thereon, in a place to be viewed by others (e.g., hanging the holding device on a door knob, placing it under a car windshield wiper or on a door handle, etc.). Of course, many other structures for providing a message display area may be used without departing from this invention. For example, the holding device may be formed so as to include a detachable and/or replaceable pad, roll, or other type of paper supply.

Additional aspects of this invention relate to methods for holding a pair of footwear, e.g., using holding devices of the types described above. As can be seen taking into consideration FIGS. 1–12 and the description above, such methods may include securing a holding device to at least a first projection or raised area extending from a sole member of the first article of footwear by extending the projection(s) or raised area(s) through corresponding opening(s) defined in the holding device. If desired, in at least some examples of the invention, the projection(s) (or raised area(s)) and opening(s) may be sized and arranged so as to provide a relatively tight but detachable friction fit and engagement between the holding device and the projection(s) or raised area(s) (in other examples, if desired, the fit between the projection(s) or raised area(s) on the footwear and opening(s) on the holding device may be relatively loose, such that the holding device is freely removable from the projection(s) or raised area(s) without departing from this invention). Once through the opening(s) in the holding device, the projection(s) or raised area(s) further may extend into and/or engage with one or more cavity(ies) and/or recess area(s) provided in a sole member of a second article of footwear. Again, the fit between the projection(s), raised area(s), cavity(ies), and/or recessed area(s), in at least some examples of this invention, may be a relatively tight friction fit, to thereby detachably connect the first article of footwear to the second article of footwear (e.g., the holding device may be sandwiched and held between the sole member of the first article of footwear and the sole member of the second article of footwear without the need for other attachment elements or devices). In other systems or methods, if desired, an independent attachment element or system may be provided to, at least in part, hold the entire system together.

In accordance with at least some examples of this invention, the holding device and its corresponding attached articles of footwear may be suspended on another element (e.g., a sales display rack or device, a hook, a closet rod, etc.) using a suspension element optionally attached to, included with, and/or integrally formed as part of the holding device. As noted above, many different types of suspension devices or systems may be used without departing from this invention. In the examples illustrated in FIGS. 5–8 and 10–12, the suspension system includes an opening provided in the holding device body member in an area of the holding device located outside the sole members of the first and second articles of footwear.

Still additional example aspects of this invention relate to use of the holding device for messaging purposes. In the illustrated examples above, the holding device is sized and shaped in a manner similar to conventional door hanging elements, such as "Do Not Disturb" signs conventionally provided in hotel rooms for use by hotel guests. In accordance with at least some examples of this invention, methods according to the invention further may include writing a message on the holding device and leaving the message for another. More specific examples of such methods may include removing the holding device from the articles of footwear, if necessary (e.g., by detaching the sole members of the articles of footwear from one another and detaching the holding device from the sole member to which it remains attached (if any)). After the holding device is detached from the sole members, a message may be written on it (e.g., the body of the holding device may be made from an erasable material, such as a whiteboard material), and the message may be left for another person, e.g., by hanging the holding device on a door or other element using the suspension system, the openings for the projections, etc. As those skilled in the art will readily appreciate, the holding device need not be suspended or otherwise attached to another element in order to use its messaging system (e.g., if desired, the message may be written on the holding member and it may simply be left on a table, counter, seat, windshield, or other location to be found by the intended message recipient).

Of course, many variations in the structures and methods described above may be provided without departing from this invention. For example, in addition to the numerous potential variations and alternatives described above, the sole member of an individual article of footwear may include both some projections (or raised areas) and some cavities (or recessed areas) that fit into, engage, and/or interlock with corresponding complementary elements provided on the other article of footwear. As another example, if desired, either or both sides of the holding device may include one or more projections in addition to and/or instead of one or more openings, and these projection(s) may fit into, engage, and/or interlock with corresponding recesses or cavities provided in one or more of sole members. As still another example, if desired, the holding device may be constructed from multiple pieces (e.g., each individual piece may include one or more openings or projections, the holding device may include a detachable suspension device or system, etc.). Many other variations and/or combination of the features, optional, and/or alternative structures described above may be used without departing from this invention.

Also, as noted above, this invention is not limited to use with sandal or thong type articles of footwear as illustrated in the drawings. Rather, aspects of this invention may be practiced with a wide variety of different shoe constructions and structures, and a wide variety of different upper, insole, midsole, and/or outsole structures, materials, constructions, and interconnections may be used without departing from this invention.

Accordingly, while the invention has been described with respect to specific examples including presently preferred modes of carrying out the invention, those skilled in the art will appreciate that there are numerous variations and permutations of the above described systems and techniques. Thus, the spirit and scope of the invention should be construed broadly as set forth in the appended claims.

We claim:

1. A footwear system, comprising:

a holding device including a body member with a first opening defined therein;

a first article of footwear having a first sole member, wherein the first sole member includes a first projection, wherein the first projection extends through the first opening of the holding device; and a second article of footwear having a second sole member, wherein the second sole member includes a first cavity defined therein, wherein the first projection extends into the first cavity such that the holding device is sandwiched between the first sole member and the second sole member, and wherein at least a portion of the holding device extends outside of the first sole member and the second sole member.

2. A footwear system according to claim 1, wherein the body member includes a second opening defined therein, the first sole member includes a second projection, and the second sole member includes a second cavity, wherein the second projection extends through the second opening and into the second cavity.

3. A footwear system according to claim 2, wherein the body member includes a third opening defined therein, the first sole member includes a third projection, and the second sole member includes a third cavity, wherein the third projection extends through the third opening and into the third cavity.

4. A footwear system according to claim 1, wherein the holding device further includes an aperture located in the portion of the holding device outside the first sole member and the second sole member.

5. A footwear system according to claim 1, wherein the holding device further includes a slit or a canal-shaped opening leading to the aperture.

6. A footwear system according to claim 1, wherein the first projection and the first cavity have a substantially circular cross-sectional area.

7. A footwear system according to claim 1, further comprising:

a suspension system attached to or included with the holding device.

8. A footwear system according to claim 1, wherein the holding device includes a handwritten message display area.

9. A footwear system, comprising:

a first article of footwear having a first sole member, wherein the first sole member includes a first raised area and a second raised area with a first recessed area provided between the first raised area and the second raised area;

a second article of footwear having a second sole member, wherein the second sole member includes a third raised area, wherein the third raised area at least partially fits inside the first recessed area of the first sole member; and a holding device including a body member with a first opening and a second opening defined therein, wherein the first raised area extends into the first opening, the second raised area extends into the second opening, and a portion of the body member between the first opening and the second opening lies adjacent the third raised area.

10. A footwear system according to claim 9, wherein the second sole member includes a fourth raised area and a second recessed area provided between the third raised area and the fourth raised area.

11. A footwear system according to claim 10, wherein the first sole member includes a fifth raised area, and wherein a third recessed area is provided in the first sole member between the second raised area and the fifth raised area.

12. A footwear system according to claim 11, wherein the second raised area of the first sole member at least partially fits inside the second recessed area, and wherein the fourth raised area of the second sole member at least partially fits inside the third recessed area.

13. A footwear system according to claim 9, wherein the holding device further includes an aperture located outside the first sole member and the second sole member.

14. A footwear system according to claim 13, wherein the holding device further includes a slit or a canal-shaped opening leading to the aperture.

15. A footwear system according to claim 9, further comprising:

a suspension system attached to or included with the holding device.

16. A footwear system according to claim 9, wherein the holding device includes a handwritten message display area.

17. A method for holding a pair of footwear including a first article of footwear and a second article of footwear, comprising:

securing a holding device to at least a first projection or raised area extending from a sole member of the first article of footwear by extending the first projection or raised area through a first opening defined in the holding device; and engaging the first projection or raised area with a first cavity or recess area provided in a sole member of the second article of footwear to thereby detachably connect the first article of footwear to the second article of footwear, wherein the holding device is sandwiched between the sole member of the first article of footwear and the sole member of the second article of footwear.

18. A method according to claim 17, further comprising:

hanging the holding device on another element through an opening provided in the holding device in an area of the holding device located outside the sole members of the first and second articles of footwear.

19. A method according to claim 17, wherein the securing includes securing the holding device to a second projection or raised area extending from the sole member of the first article of footwear by extending the second projection or raised area through a second opening defined in the holding device, and wherein the engaging includes engaging the second projection or raised area with a second cavity or recess area provided in the sole member of the second article of footwear.

20. A method according to claim 19, wherein the securing includes securing the holding device to a third projection or raised area extending from the sole member of the first article of footwear by extending the third projection or raised area through a third opening defined in the holding device, and wherein the engaging includes engaging the third projection or raised area with a third cavity or recess area provided in the sole member of the second article of footwear.

21. A method according to claim 17, further comprising:

detaching the sole member of the first article of footwear from the sole member of the second article of footwear; and detaching the holding device from the sole member of the first article of footwear.

22. A method according to claim 21, further comprising:

after detaching the holding device from the sole member of the first article of footwear, hanging the holding device on a door.

23. A method according to claim 22, further comprising:

writing a message on the holding device.

24. A method according to claim 21, further comprising:

writing a message on the holding device.

25. A method according to claim 17, further comprising:

suspending the holding device from another element.

26. A method according to claim 17, further comprising:

writing a message on the holding device.

* * * * *